US005475473A

United States Patent [19]

Masuda et al.

[11] Patent Number: 5,475,473

[45] Date of Patent: Dec. 12, 1995

[54] ELECTRIC CHARGING MEMBER AND ELECTRIC CHARGING APPARATUS

[75] Inventors: Yoshitomo Masuda, Hamura; Hajime Tamura, Kawasaki; Takahiro Kawagoe, Tokorozawa; Yoshio Takizawa; Gaku Yakushiji, both of Kodaira; Kazuya Murata; Shohei Morikawa, both of Yokohama, all of Japan

[73] Assignee: Bridgestone Corporation, Tokyo, Japan

[21] Appl. No.: 309,678

[22] Filed: Sep. 21, 1994

[30] Foreign Application Priority Data

| | | | |
|---|---|---|---|
| Sep. 22, 1993 | [JP] | Japan | 5-259025 |
| Sep. 22, 1993 | [JP] | Japan | 5-259385 |
| Nov. 26, 1993 | [JP] | Japan | 5-297052 |
| Jan. 27, 1994 | [JP] | Japan | 6-007944 |
| Mar. 24, 1994 | [JP] | Japan | 6-053534 |
| Sep. 13, 1994 | [JP] | Japan | 6-218884 |

[51] Int. Cl.[6] ..... G03G 15/02

[52] U.S. Cl. ..... 355/219; 361/225; 430/902

[58] Field of Search ..... 355/219; 361/225, 361/230; 430/902

[56] References Cited

U.S. PATENT DOCUMENTS

| | | | |
|---|---|---|---|
| 5,112,708 | 5/1992 | Okunuki et al. | 361/225 X |
| 5,192,974 | 3/1993 | Ikegawa et al. | 355/219 |

FOREIGN PATENT DOCUMENTS

| | | | |
|---|---|---|---|
| 1-211779 | 8/1989 | Japan . | |
| 1-205180 | 8/1989 | Japan . | |
| 4-14067 | 1/1992 | Japan | 355/219 |
| 5-127494 | 5/1993 | Japan | 355/219 |

*Primary Examiner*—William J. Royer

*Attorney, Agent, or Firm*—Sughrue, Mion, Zinn, Macpeak & Seas

[57] ABSTRACT

An electric charging member and electric charging apparatus are described, including the surface of the charging member being formed of a resin layer including a nylon copolymer containing at least 15% by weight of nylon 12 or a urethane-modified acrylic resin containing 5–80% by weight of an acrylic resin component.

20 Claims, 2 Drawing Sheets

ELECTRIC CHARGING MEMBER AND ELECTRIC CHARGING APPARATUS

BACKGROUND OF THE INVENTION

1. Field of the Invention

This invention relates to a charging member and apparatus for providing electric charge to an object to be charged such as a photoconductor used in an electrophotographic or electrostatic recording process in copying and printing machines.

2. Prior Art

The conventional electrophotographic process used in copying machines is by evenly charging the photoconductor at its surface, projecting an image to the photoconductor from an optical system to eliminate electric charges in areas exposed to light, thereby forming a latent image, applying toner to the photoconductor to form a toner image, and transferring the toner image to paper. The first step of charging the photoconductor generally employs a corona discharge mode. However, the corona discharge mode is undesirable from the standpoint of safety and maintenance of the machine since application of voltage as high as 5 to 10 kV is required. The corona discharge also gives rise to an environmental problem since harmful substances such as ozone and NOx generate.

It was recently proposed to bring a charging member having voltage applied thereto in contact with an object to be charged, typically a photoconductor, thereby charging the object as disclosed in Japanese Patent Application Kokai (JP-A) Nos. 205180/1989 and 211779/1989. This contact mode enables charging at a lower applied voltage than the corona discharge mode and minimizes ozone evolution, indicating the possibility of overcoming the problems of the corona discharge mode.

Charging members used in the contact mode are rollers made of conductive rubber having conductive particles such as carbon dispersed therein with or without a coating of nylon or polyurethane. The conductive rubber rollers without a coating should have an increased loading of conductive particles for low resistivity, which in turn, results in an increased rubber hardness to damage the surface of an object to be charged. Chemicals blended in the rubber can migrate to the skin layer to contaminate the photoconductor to deteriorate its charging ability.

The conductive rubber rollers with a coating of nylon or polyurethane are effective for preventing contamination of the photoconductor, but experience changes in resistance with the surrounding environment. A low temperature, low humidity environment obstructs even charging, sometimes causing black peppers and fog upon reversal development. It is possible to control the resistance of the skin layer by adding conductive particles. However, since the resistivity largely varies with the amount of conductive particles added, the desired resistivity is available with difficulty from the standpoint of manufacture, often resulting in variations of charging ability.

More lately, it was found that the contact charging mode using conductive rubber rollers having conductive particles such as carbon dispersed therein raised some problems including noise upon application of AC voltage and a loss of the photoconductor's toner sticking inability due to direct contact.

OBJECT OF THE INVENTION

An object of the present invention is to provide a charging member and apparatus which are improved in charging ability and environmental stability thereof and eliminates a variation in charging ability during manufacture and sticking to an image-bearing member.

Another object of the present invention is to provide a charging member and apparatus which have the advantages of electric power saving, suppressed ozone evolution, noise reduction, and minimized toner sticking to an image-bearing member.

SUMMARY OF THE INVENTION

The present invention is directed to a charging member which is abutted and contacted at its surface with an object to be charged wherein the object is charged by applying a voltage between the charging member and the object. The inventors have found that when the surface of the charging member in abutment contact with the object, for example, a skin layer circumscribing the outer surface of a conductive rubber roller is formed of a resin layer comprising a nylon copolymer containing at least 15% by weight of nylon 12 or a urethane-modified acrylic resin containing 5 to 80% by weight of an acrylic resin component, the resulting charging member experiences minimal resistance change with the ambient environment and presents improved environmental stability of charging. Where the surface resistance is modified by further adding conductive particles, the resistance value is relatively moderately changed in accordance with the amount of conductive particles added. This ensures adjustment to a desired resistance value. An image forming apparatus using this charging member can produce images of quality without toner sticking.

As is known in the art, if the surface of the abutment of the charging member with the object to be charged is formed of a nylon coating, it is fairly effective for improving the contamination resistance of the object. N-methoxymethylated nylon is typical of the nylon used for this purpose. Undesirably, a solution of N-methoxymethylated nylon increases its viscosity with the lapse of time and the coating increases its electric resistance due to crosslinking or the like. In contrast, a nylon copolymer is stable in solution viscosity and free of crosslinking so that the resulting coating has a consistent resistance. However, a charging roller using a conventional alcohol-soluble nylon copolymer as a skin layer is susceptible to toner sticking. The term "toner sticking" means that in an image forming apparatus comprising an image bearing member or photoconductor drum 6, a charging roller 5, and a cleaning blade 12 set as shown in FIG. 3, some toner which has escaped past the cleaning blade 12 can be pressed against the image bearing member 6 upon contact with the charging roller 5 whereby the toner is fused to the surface of the image bearing member 6.

Because of this generation mechanism, there is the tendency that this toner sticking phenomenon occurs more frequently as the skin layer of the charging member is increased in hardness. On the other hand, nylon copolymers are reduced in flexural modulus and accordingly, hardness as the melting point lowers. Effective means for lowering the melting point of nylon copolymers is to use a nylon 12 component as a comonomer. We have found that among various nylon copolymers, those containing at least 15% by weight of nylon 12 are effective for suppressing toner sticking.

Also a conventional urethane elastomer used as the skin layer is stable in solution viscosity and presents a flexible film which experiences little change of electric resistance with the lapse of time. However, urethane elastomers are generally tacky so that when used as a skin layer of a conductive member, sticky contact can occur between the skin layer and an object to be charged, prohibiting smooth separation. Toner and debris deposit on such a tacky skin layer, causing uneven charging.

Acrylic resins are less tacky and resistant against contamination, but have high hardness. When they are used as a skin layer of a conductive member, the member as a whole is increased in hardness, which can cause uneven charging and toner sticking. This is because of the tendency that the toner sticking phenomenon occurs more frequently as the charging member skin layer is increased in hardness due to the aforementioned generation mechanism.

Quite unexpectedly, when the skin layer is formed of a resin layer comprising a urethane-modified acrylic resin containing 5 to 80% by weight of an acrylic resin component, the resulting charging member experiences minimal resistance change with the ambient environment and presents improved environmental stability of charging. Use of such a urethane-modified acrylic resin containing 1 to 50% by weight of a silicon component is effective for improving intimate contact with the photoconductor drum. The urethane-modified acrylic resin according to the present invention shows such a peculiar effect. On the other hand, the conventional urethane resin and acrylic resin do not give such an effect.

The urethane-modified acrylic resin layer may further contain silica, for example silicic anhydride, silicic acid hydrate or a silicate. Further, the urethane-modified acrylic resin layer may further contain curing agent. Silicic anhydride, silicic acid hydrate or a silicate may be added to the resin layer for suppressing pinhole leak and improving close contact with the photoconductor drum. The resin layer of urethane-modified acrylic resin is further increased in film strength and hence in close contact with the photoconductor drum when the resin is in crosslinked form.

We have also found that when particles having a particle size of 35 to 100 μm are distributed in the proximity of the surface of the charging member in abutment contact with the object to be charged, the charging member has the advantages of power saving, reduced ozone generation, reduced noise upon charging, and minimized toner fusion to the image bearing member.

Accordingly, the present invention in one aspect provides a charging member which is contacted at its surface with an object to be charged wherein the object is charged by applying a voltage between the charging member and the object.

In another aspect, the present invention provides a charging apparatus comprising a charging member which is contacted at its surface with an object to be charged and means for applying a voltage between the charging member and the object.

In either aspect, the surface of the charging member in contact with the object is formed of a resin layer comprising a nylon copolymer containing at least 15% by weight of nylon 12. In a second form, the surface of the charging member in contact with the object is formed of a resin layer comprising a urethane-modified acrylic resin containing 5 to 80% by weight of an acrylic resin component. In a third form, particles having a particle size of 35 to 100 μm are distributed in the proximity of the surface of the charging member in contact with the object.

BRIEF DESCRIPTION OF THE DRAWINGS

The above and other objects, features and advantages of the invention will be better understood by reading the following description taken in conjunction with the accompanying drawings.

DETAILED DESCRIPTION OF THE INVENTION

Figure 1:
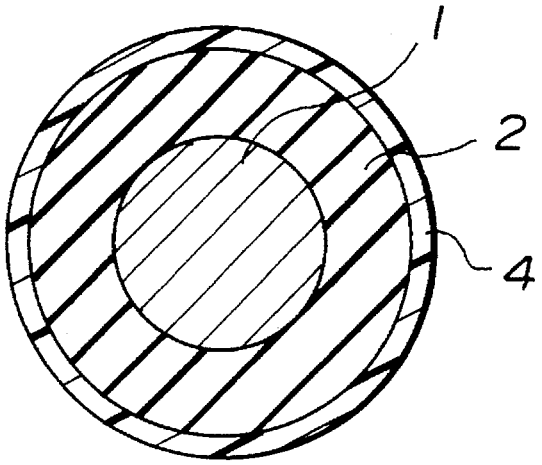
FIG. 1 is a schematic cross section of a charging roller according to one embodiment of the invention.
Figure 2:
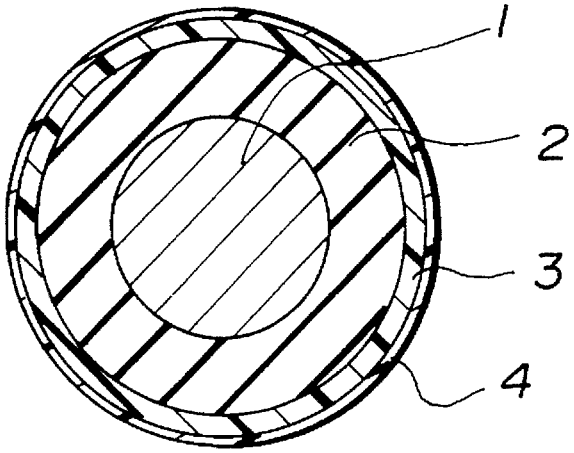
FIG. 2 is a schematic cross section of a charging roller according to another embodiment of the invention.

Referring to FIG. 1, one exemplary charging member according to the present invention is illustrated as comprising a cylindrical metal core or mandrel 1, an annular layer or hollow cylinder (substrate) 2 of a conductive elastomer circumscribing the core 1, and an annular skin layer 4 circumscribing the cylinder 2. FIG. 2 illustrated another exemplary charging member according to the present invention which is of similar concentric layered structure to FIG. 1 except that an annular resistance layer 3 is formed between the substrate 2 and the skin layer 4. If desired, the core 1 may be omitted and the substrate 2 may have a multi-layer structure of two or more layers.

The substrate 2 may be formed of metals, polyurethane, natural rubber, butyl rubber, nitrile rubber, polyisoprene rubber, polybutadiene rubber, silicone, styrene-butadiene rubber, ethylene-propylene rubber, and chloroprene rubber. The substrate may be formed of foam preferably having an extent of foaming of 1.2 to 10 times. The foam may have a skin layer at the surface. Conductive aids such as carbon black may be added if desired. Preferably the cylinder 2 has a volume resistivity of $10^1$ to $10^{10}$ Ω-cm.

The resistance layer 3 intervenes between the substrate 2 and the skin layer 4 for the purpose of controlling the resistance of the charging member. This resistance layer may be formed of a composition comprising matrix polymers and conductive particles. The matrix polymers include polyurethane, SBS, EVA, polyethylene, polypropylene, polyvinyl alcohol, silicone rubber, chloroprene rubber, and epichlorhydrin rubber though not limited thereto. The conductive particles include carbon black if required, and particles of metal oxides such as tin oxide and titanium oxide. Preferably the resistance layer 3 has a volume resistivity of $10^3$ to $10^{13}$ Ω-cm.

It is appreciated that the charging member of the invention is not limited to the shape of a roll as shown in FIGS. 1 and 2. The charging member may take the form of a plate, rectangular block, sphere, brush and the like. Often the charging member is configured to a roll or brush shape, most often a roll shape.

According to the invention, the surface of the charging member in abutment contact with the object to be charged, more specifically the skin layer 4 of the embodiments illustrated in FIGS. 1 and 2 is a resin layer comprising a nylon copolymer containing at least 15% by weight of a nylon 12 component or a urethane-modified acrylic resin containing 5 to 80% by weight of an acrylic resin component.

The nylon copolymer constituting the skin layer of the charging member is selected from a number of nylon copolymers including nylon 6/66/12, 6/610/12, 6/612/12, 6/66/610/12, 6/66/11/12, 6/69/610/12, 6/66/69/12, 6/66/612/12, and 6/610/11/12. The nylon copolymer should contain at least 15% by weight, preferably 15 to 60% by weight, more preferably 20 to 50% by weight of nylon 12. The nylon copolymer preferably has a melting point of up to 120° C., more preferably 70° to 120° C., most preferably 90° to 110° C.

The nylon copolymers may be contained in the contact portion or skin layer of the charging member alone or in admixture of two or more and as a sole component or in admixture with another resin. In the latter case, the content of the resin other than the nylon copolymer is preferably less than 50% by weight, more preferably 5 to 30% by weight of the skin layer. Examples of the other resin include polyester, phenolic resin, polyurethane, epoxy resin, urea resin, and acrylic resin.

In the second form, a urethane-modified acrylic resin containing 5 to 80% by weight of an acrylic resin component is used for the skin layer. Acrylic resins are modified with urethane components by various methods. It is more effective from the standpoints of compatibility, solution stability, and film flexibility to chemically bond acryl and urethane resin components. More particularly, a urethane-modified acrylic resin is synthesized by reacting an acryl polymer having a hydroxyl group introduced therein with the aid of β-hydroxyethyl methacrylate or the like with a urethane prepolymer terminated with an isocyanate group, or by reacting an acryl component having a hydroxyl group at one or both ends of its molecule with a urethane prepolymer terminated with an isocyanate group. This reaction is illustrated by the following scheme:

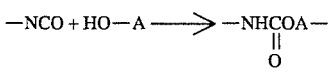

wherein A represents acrylic acid or acrylate monomer or oligomer. In the resulting copolymer, urethane and acryl units may be concatenated in block or graft form.

The method of modifying acrylic resins with urethane components is not limited to the above examples and includes a method of adding diisocyanate to an acryl/diol mix system and a method of adding a both end isocyanate-terminated polyester or polyether to acryl monomer and polymerizing the urethane acrylate. The acryl resin component used in these synthetic methods is preferably one having a glass transition temperature Tg of from room temperature to about 120° C. as a polymer and may contain therein ethyl methacrylate, isobutyl methacrylate, glycidyl methacrylate or the like as well as the aforementioned β-hydroxyethyl methacrylate. They are used singly or in combination. The urethane-modified acrylic resin should contain 5 to 80% by weight, preferably 10 to 60% by weight, more preferably 20 to 60% by weight of an acrylic resin component.

The urethane-modified acrylic resins of the present invention are quite different from the conventional urethane resins and acrylic resins. The conventional urethane resins cannot solve the problem on adhesiveness to an object to be charged. The conventional acrylic resins cannot solve the problem on the cracks of the charging member and the uneven charging. On the other hand, the urethane-modified acrylic resins of the present invention can solve the above problems. The formulation of acrylic resin component is important for attaining the above effect.

A silicon component may be contained in the urethane-modified acrylic resin for improving intimate contact with the photoconductor drum. This may be achieved by preparing a urethane prepolymer from a polyol having a silicone chain and reacting the urethane prepolymer with an acryl component to synthesize a urethane-modified acrylic resin. The urethane prepolymer preferably contains 2 to 80% by weight, more preferably 5 to 50% by weight of a silicone component. The content of a silicone component in the resulting urethane-modified acrylic resin is preferably 1 to 50% by weight, more preferably 1 to 30% by weight.

The urethane-modified acrylic resins may be contained in the contact portion or skin layer of the charging member alone or in admixture of two or more and as a sole component or in admixture with another resin. Examples of the other resin used in addition to the urethane-modified acrylic resin include polyester, phenolic resin, polyamide, epoxy resin, urea resin, and urethane resin.

The contact portion or skin layer of the charging member should preferably have a volume resistivity of $10^6$ to $10^{13}$ Ω-cm, especially $10^7$ to $10^{11}$ Ω-cm. With a volume resistivity of less than $10^6$ Ω-cm, the charging member can be broken upon voltage application. A volume resistivity of more than $10^{13}$ Ω-cm would result in an insufficient charging property and cause fog. The volume resistivity is adjusted by adding conductive particles to the material of which the contact portion or skin layer is formed, that is, nylon copolymer or urethane-modified acryl resin base material. The conductive particles include carbon black, and particles of metal oxides such as tin oxide and titanium oxide. Use of carbon black is preferred while a mixture of carbon black and metal oxide is acceptable. The material of which the contact portion or skin layer of the charging member is formed and to which conductive particles are added changes its resistance value in a relatively moderate manner in accordance with the amount of conductive particles added. This ensures easy and precise adjustment of the contact portion or skin layer to a desired resistance value.

To the resin layer which has been adjusted in overall resistance by adding carbon black, silica known as white carbon may be added for suppressing local pinhole leak and improving close contact with the photoconductor drum. Examples of white carbon include silicic anhydride obtained by a dry method (e.g., Aerosil by Degussa Co.), silicic acid hydrate obtained by a wet method (e.g., Furcasil by Bayern A.G.), and silicates such as magnesium silicate.

The resin layer may further contain curing agent for improving its film strength. Curing is effected by introducing reactive groups such as hydroxyl and isocyanate groups into the base and curing agent while self-crosslinking by heating is acceptable. Use of the curing agent is effective for improving the durability of the coating because the coating is improved in stretchability by introducing into the curing agent a flexibility-imparting group such as a difunctional diisocyanate group. The curing agent may further contain a silicone component for improving close contact.

Preferably, the resin layer constituting the contact portion or skin layer of the charging member is 1 to 200 μm, as measured in a radial direction in the case of a roll.

The skin layer is formed on the cylindrical sleeve by any desired method. A dipping method is by dispersing the nylon copolymer or urethane-modified acryl resin and conductive powder in a suitable solvent to form a coating composition, immersing the sleeve in the composition and pulling up the sleeve. Spraying is also effective for the coating purpose. Alternatively, a mixture of the polymer component and conductive powder is melted and molded into a tube, the sleeve is inserted into the tube, and tight contact is established therebetween.

Although the charging member of the invention is generally configured as comprising the cylindrical substrate or sleeve 2 having an adequate conductivity and the cylindrical skin layer 4 of nylon copolymer or urethane-modified acryl resin joined thereto as shown in FIGS. 1 and 2, it is possible to form the charging member solely of a material comprising a nylon copolymer or urethane-modified acryl resin.

The charging member using a nylon copolymer or urethane-modified acryl resin as defined above substantially eliminates the drawbacks of the prior art including contamination of the photoconductor drum by a rubber roller, generation of black peppers and fog during reversal development, and toner sticking and thus provides for a charging apparatus which is improved in charging ability and stability thereof. Therefore, the charging member and apparatus of the invention are applicable to a wide variety of copying, printing and similar machines employing an electrophotographic or electrostatic process.

In the third form, particles having a particle size of 35 to 100 μm are distributed in the charging member in the proximity of its surface in contact with the object to be charged, typically photoconductor drum. Most often, such particles are distributed in the skin layer of the charging member. Particles with a size of less than 35 μm are little effective for noise reduction upon charging whereas particles with a size of more than 100 μm exacerbate toner sticking.

Particles are contained in the skin layer in any desired amount, preferably about 3 to about 50 parts, more preferably about 5 to about 30 parts by weight per 100 parts by weight of the polymer constituting the skin layer. More than 50 parts of particles on this basis would adversely affect working of the polymer composition.

The particles used herein may be either electrically insulating or conductive. In the case of insulating particles, they should be distributed and covered with a conductive coating or elastomer so that they may not be exposed at the outermost surface of the charging member. The conductive particles include particles of conductive polymers such as polyaniline, polypyrrole, polyfuran, and polythiophene, metal particles, and composite particles whose surface is covered with carbon, metal or metal oxide. The insulating particles include particles of acrylic resin, nylon resin, epoxy resin, silica, and calcium carbonate, with the acryl and nylon resins being preferred. An acryl resin of crosslinking type is especially preferred from the standpoint of film formation because it is less susceptible to swelling, shrinkage and deformation.

The polymer of which the skin layer is formed is not critical although it is preferably a polymer composition comprising a resin and conductive particles. Exemplary resins include nylon, polyester, urethane-modified acrylic resin, phenolic resin, polyamide, epoxy resin, urea resin, and urethane resin. The resins may be used alone or in admixture of two or more. Exemplary conductive particles include carbon black and particulate metal oxides such as tin oxide and titanium oxide. The surface resistivity is as previously defined.

The particles should be distributed in a surface region of the charging member which extends from the outermost surface to a depth of 1,000 μm or less, preferably within a depth of 100 μm, more preferably within a depth of 50 μm. Then the proximity of the surface of the charging member in contact with the photoconductor drum is the outermost layer if the charging member is a roll or one side surface layer in contact with the photoconductor drum if the charging member is a plate. Further, particles may be distributed either locally in such a surface region or entirely throughout the charging member.

Any desired method may be used for the distribution of particles. Where the skin layer is formed as a coating, particles are previously blended in the coating composition whereupon the particles are distributed at the same time as the composition is coated to the charging member. Also where a coating or elastomeric layer is formed by melt coating or extrusion, particles are previously blended in the starting material.

The charging member having particles distributed in the proximity of the contact surface as defined above has the advantages of power saving, suppression of ozone generation, noise reduction, and minimized toner fusion to an image-bearing member. Therefore, the charging member and apparatus of the invention are applicable to a wide variety of copying, printing and similar machines employing an electrophotographic or electrostatic process.

Figure 3:
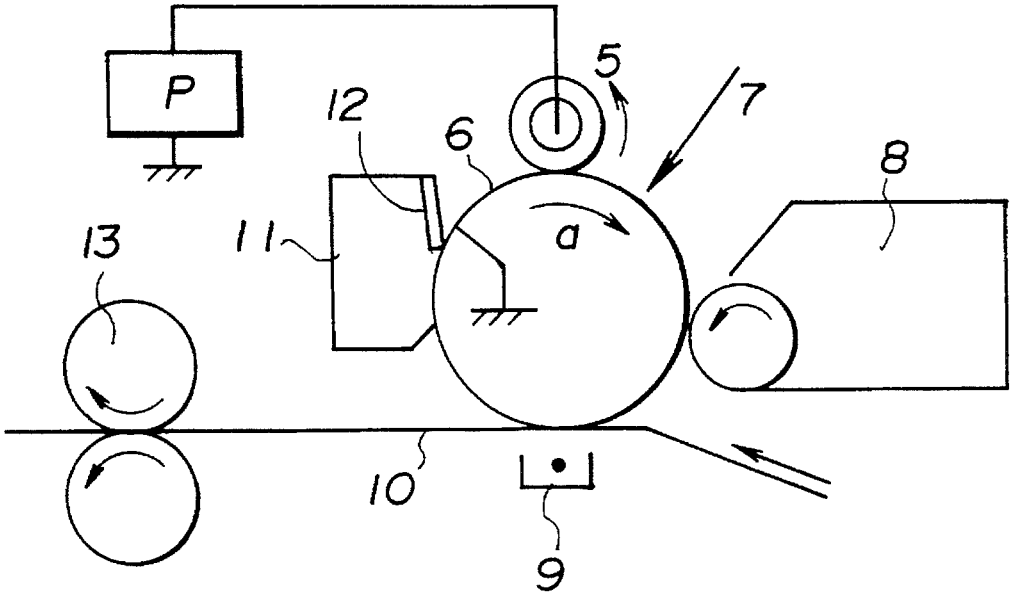
FIG. 3 is a schematic view of an image forming system utilizing a charging apparatus according to the invention.

FIG. 3 illustrates one exemplary image forming system using the charging apparatus of the invention. The system includes an image bearing member 6 in the form of an electrophotographic photoconductor drum which rotates at 100 mm/sec., for example, in the direction of arrow a. A charging member 5 in the form of a charging roller is in abutment or contact with the photoconductor drum 6. The roller 5 is connected to a power supply P for applying thereto a constant DC voltage or optionally, a high voltage in the form of a DC voltage with an overlapping AC voltage, thereby providing electric charges to the photoconductor drum in a uniform manner. The photoconductor drum is exposed to light at 7. For example, scanning exposure from a semiconductor laser or exposure from an LED or tungsten halogen lamp is effective for forming an electrostatic latent image. The latent image is then visualized as a toner image by means of a developing unit 8. The toner image is then transferred to a support 10, typically a sheet of paper by means of a transfer roller or electrode 9 and fixed through a fixing unit 13 whereupon a printed sheet is delivered. Also illustrated in FIG. 3 is a cleaning unit 11 including a cleaning blade 12 which comes in contact with the photoconductive drum 6 upstream of the charging roller 5.

The apparatus of the present invention should not be restricted to FIG. 3.

EXAMPLE

Examples of the present invention are given below by way of illustration and not by way of limitation. The term "phr" is parts by weight per hundred parts by weight of a polymer component.

In the cross section of FIGS. 1 and 2, the charging member of the invention is illustrated as a roller of a multi-layer structure comprising the core 1 of iron, SUS or the like and two or three annular layers circumscribing the core 1. The structure of FIG. 1 includes the layer or sleeve 2 of a conductive elastomer of urethane rubber, urethane foam or ethylene-propylene rubber having conductive carbon dispersed therein for imparting conductivity (about $10^7$ Ω). The structure of FIG. 2 includes the layer or sleeve 2 of a conductive elastomer of butadiene or isoprene rubber having conductive carbon dispersed therein for imparting conductivity (about $10^3$ Ω) and the resistance layer 3 of urethane rubber having conductive carbon dispersed therein for providing a controlled resistance. The skin layer 4 is formed on the sleeve 2 in FIG. 1 or the layer 3 in FIG. 2 as a coating layer.

The image forming system used is shown in FIG. 3.

EXAMPLE 1

To a nylon 6/66/610/12 copolymer (weight ratio 30/10/30/30, melting point 95° C.) in methanol was added 15 phr of carbon black Printex 95 (manufactured by Degussa, Inc.). The ingredients were mixed in a red devil to form a dispersion. A polyurethane rubber roller having a skin layer at the surface and a resistance of $10^7$ Ω was dipped in the dispersion and dried to form a skin layer of about 50 μm thick on the polyurethane, obtaining a roller-shaped charging member as shown in FIG. 1.

EXAMPLE 2

A charging roller was manufactured by the same procedure as in Example 1 except that the nylon copolymer was replaced by a nylon 6/66/11/12 copolymer (weight ratio 30/20/20/30, melting point 93° C.).

EXAMPLE 3

The procedure of Example 1 was repeated except that a roller consisting of a conductive elastomer sleeve of isoprene rubber and a resistance layer of urethane rubber thereon was dipped in the dispersion, fabricating a charging roller having a skin layer of about 10 μm thick as shown in FIG. 2.

EXAMPLE 4

A charging roller was manufactured by the same procedure as in Example 1 except that 20 phr of carbon black 2400B (manufactured by Mitsubishi Chemicals K.K.) was added to the nylon copolymer.

Comparative Example 1

The same polyurethane roll as used in Example 1 was dipped in a solution of N-methoxymethylated nylon 6 in methanol and dried to form a skin layer of about 50 μm thick on the polyurethane substrate, fabricating a roller-shaped charging member as shown in FIG. 1.

Comparative Example 2

The same polyurethane roll as used in Example 1 was used as a charging member without forming a skin layer.

Comparative Example 3

A charging roller was manufactured by the same procedure as in Example 1 except that the nylon copolymer was replaced by a nylon 6/66/610 copolymer (melting point 140° C.).

Comparative Example 4

A charging roller was manufactured by the same procedure as in Example 1 except that the nylon copolymer was replaced by a nylon 6/66/610/12 copolymer (weight ratio 45/25/25/5, melting point 140° C.).

The skin layer of these charging members (Examples 1–4 and Comparative Examples 1–4) was examined for volume resistivity, charging ability, and toner sticking. Volume resistivity measurement and a charging ability test were made both at a temperature of 23° C. and a relative humidity of 55% and at a temperature of 15° C. and a relative humidity of 10%. Resistivity was measured by forming the same layer as the above-formed skin layer, but on an aluminum sheet. The charging ability test was carried out by mounting the above-prepared roller as a charging member in the system shown in FIG. 3, rotating the roller and the photoconductor drum, applying a voltage in the form of a DC voltage of −0.75 kV with an overlapping AC voltage of 1.5 kV across the members, and measuring the charged potential of the photoconductor drum at the position destined for development. Toner fusion was tested by continuously operating the image forming system of FIG. 3 in a high temperature/high humidity environment (33° C./RH 85%) for producing printed images. At the end of 5,000 prints, the image and the surface state of the photoconductor drum were observed. Toner fusion was rated good "○", fair "Δ" or poor "×".

The results are shown in Table 1.

TABLE 1

| | | Skin layer | | | Photo-conductor | |
|---|---|---|---|---|---|---|
| | Composition | Nylon 12 content (wt %) | Melting point (°C.) | Volume resistance* (Ω-cm) | surface potential* (−V) | Toner fusion rating |
| Example 1 | nylon 6/66/610/12 | 30 | 95 | $3 \times 10^8$<br>$7 \times 10^8$ | 630<br>610 | ○ |
| Example 2 | nylon 6/66/11/12 | 30 | 93 | $5 \times 10^8$<br>$8 \times 10^8$ | 630<br>610 | ○ |
| Example 3 | nylon 6/66/610/12 | 30 | 95 | $2 \times 10^9$<br>$5 \times 10^9$ | 610<br>600 | ○ |
| Example 4 | nylon 6/66/610/12 | 30 | 95 | $3 \times 10^8$<br>$7 \times 10^8$ | 630<br>610 | ○ |
| Comparative Example 1 | N-methoxy-methylated nylon 6 | — | — | $2 \times 10^{10}$<br>$9 \times 10^{11}$ | 520<br>400 | ○ |
| Comparative Example 2 | — | — | — | — | 120<br>50 | Δ |
| Comparative Example 3 | nylon 6/66/610 | — | 140 | $5 \times 10^8$<br>$9 \times 10^8$ | 600<br>580 | X |
| Comparative Example 4 | nylon 6/66/610/12 | 5 | — | $3 \times 10^8$<br>$8 \times 10^8$ | 630<br>600 | X |

*upper values are at 23° C., RH 55%
lower values are at 15° C., RH 10%

EXAMPLE 5

To a urethane-modified acryl resin Sunprene IB-582 (manufactured by Sanyo Chemicals K.K., acryl resin content 40% by weight) in a toluene/isopropyl alcohol/butanol mixture was added 20 phr of carbon black 2400B (manufactured by Mitsubishi Chemicals K.K.). The ingredients were mixed in a red devil to form a dispersion. A polyurethane roller having a resistance of $10^7$ Ω was dipped in the dispersion and dried to form a skin layer of about 50 μm thick on the polyurethane, obtaining a roller-shaped charging member as shown in FIG. 1.

EXAMPLE 6

A charging roller was manufactured by the same procedure as in Example 5 except that a urethane-modified acryl resin EAU-2B (manufactured by Asia Industry K.K., acryl resin content 60% by weight) was used.

EXAMPLE 7

A charging roller was manufactured by the same procedure as in Example 5 except that a urethane-modified acryl resin EAU-8B (manufactured by Asia Industry K.K., acryl resin content 60% by weight, silicone content 5% by weight) was used.

EXAMPLE 8

The procedure of Example 5 was repeated except that a urethane-modified acryl resin EAU 14B-1 (manufactured by Asia Industry K.K., acryl resin content 60% by weight) was used and 17 parts by weight of a silica filler (Aerosil R972 manufactured by Japan Aerosil K.K.) was added as a binder solution. A roller having a skin layer of about 40 μm thick was obtained as shown in FIG. 2.

EXAMPLE 9

The procedure of Example 5 was repeated except that a roller consisting of a conductive elastomer sleeve of isoprene rubber and a resistance layer of urethane rubber thereon was dipped in the dispersion, fabricating a charging roller having a skin layer of about 10 μm thick as shown in FIG. 2.

Comparative Example 5

The same polyurethane roll as used in Example 5 was dipped in a solution of N-methoxymethylated nylon 6 in methanol and dried to form a skin layer of about 50 μm thick on the polyurethane substrate, fabricating a roller-shaped charging member as shown in FIG. 1.

Comparative Example 6

The same polyurethane roll as used in Example 5 was used as a charging member without forming a skin layer.

Comparative Example 7

A charging roller was manufactured by the same procedure as in Example 10 except that 100 parts by weight of the acryl resin was used as the sole resin component.

Comparative Example 8

A charging roller was manufactured by the same procedure as in Example 10 except that 100 parts by weight of the urethane resin was used as the sole resin component.

The skin layer of these charging members (Examples 5–10 and Comparative Examples 5–8) was examined for volume resistivity, charging ability, and toner fusion by the same procedures as in Example 1.

The results are shown in Table 2.

TABLE 2

| | | Skin layer | | Photo-conductor | Toner |
|---|---|---|---|---|---|
| | Composition | Acryl content (wt %) | Volume resistance* (Ω-cm) | surface potential* (−V) | fusion rating rating |
| Example 5 | urethane-modified acryl resin | 40 | $2 \times 10^8$<br>$5 \times 10^8$ | 630<br>610 | ○ |
| Example 6 | urethane-modified acryl resin | 60 | $5 \times 10^8$<br>$8 \times 10^8$ | 630<br>610 | ○ |
| Example 7 | urethane-modified acryl resin | 60 | $2 \times 10^8$<br>$8 \times 10^8$ | 630<br>610 | ○ |
| Example 8 | urethane-modified acryl resin | 60 | $6 \times 10^8$<br>$9 \times 10^8$ | 630<br>600 | ○ |
| Example 9 | urethane-modified acryl resin | 40 | $2 \times 10^8$<br>$5 \times 10^8$ | 630<br>610 | ○ |
| Comparative Example 5 | N-methoxymethylated nylon 6 | — | $2 \times 10^{10}$<br>$9 \times 10^{11}$ | 520<br>400 | ○ |
| Comparative Example 6 | — | — | — | 120<br>50 | Δ |
| Comparative Example 7 | acryl resin | 100 | $5 \times 10^9$<br>$9 \times 10^9$ | 600<br>570 | X |
| Comparative Example 8 | urethane resin | 0 | $2 \times 10^9$<br>$2 \times 10^{10}$ | 580<br>500 | Δ |

*upper values are at 23° C., RH 55%, lower values are at 15° C., RH 10%

EXAMPLE 10

To 100 parts by weight of a urethane-modified acrylic resin EAU-29B were added 20 parts by weight of carbon black 2400B and 23 parts by weight of Aerosil R974 (manufactured by Dugussa Co.). The ingredients were mixed in a red devil to form a dispersion.

From these dispersions, coatings were formed as in Example 1 to form charging rollers. Each of the rollers was subject to a pinhole leakage test by operating the roller in the image forming system shown in FIG. 3 while using a photoconductor drum having pinholes previously perforated therein. The roller was also subject to a contact test by placing the roller in abutment with a photoconductor drum under a load of 500 grams at opposite ends and keeping this contact for 3 days at 60° C.

As a result of the addition of silica, leakage and adherence are improved.

EXAMPLE 11

To 100 parts by weight of a urethane-modified acrylic resin EAU-21B (obtained by introducing a hydroxyl group into the side chain of EAU-8B-1) were added 20 parts by weight of carbon black 2400B and 23 parts by weight of Aerosil R974. The ingredients were mixed in a red devil to form a dispersion. A curing agent having an isocyanate group at the end, that is, hexamethylene diisocyanate (HMDI) trimer was added thereto.

From these dispersions, coatings were formed as in Example 5 to form charging rollers. Each of the coatings was measured for compressive strength by means of a push-pull gage. Each of the rollers was subject to a rotating durability test by rotating the roller in contact with a photoconductor drum under a load of 1 kg at opposite ends.

As a result of the addition of curing agent, the coating becomes more tough and resistant against failure.

EXAMPLE 12

A dispersion was prepared by adding 100 parts by weight of N-methoxymethylated nylon 6 (manufactured by Teikoku Chemical Industry K.K.), 80 parts by weight of titanium oxide as conductive particles and 10 parts by weight of acryl particles MR50G of crosslinking type having a particle size of 40 to 60 μm (manufactured by Soken Chemical K.K.) to methanol solvent. A roller included a metal core covered with a conductive elastomer layer of polyurethane foam having carbon black added thereto. The roller was dipped in the dispersion and dried to form a skin layer, obtaining a roller-shaped charging member as shown in FIG. 1.

EXAMPLE 13

A charging roller was manufactured by the same procedure as in Example 12 except that the acryl particles were of MR60G of crosslinking type having a particle size of 60 to 80 μm (manufactured by Soken Chemical K.K.).

EXAMPLE 14

A charging roller was manufactured by the same procedure as in Example 12 except that nylon particles Orgasol ES-4 having a particle size of 38 to 42 μm (manufactured by Nippon Rilsan K.K.) were used.

EXAMPLE 15

A charging roller was manufactured by the same procedure as in Example 12 except that silica particles having a particle size of 40 to 90 μm were used.

Comparative Example 9

A charging roller was manufactured by the same procedure as in Example 12 except that the acryl particles were of MR7G of crosslinking type having a particle size of 3 to 10 μm (manufactured by Soken Chemical K.K.).

Comparative Example 10

A charging roller was manufactured by the same procedure as in Example 12 except that the acryl particles were omitted.

Comparative Example 11

A charging roller was manufactured by the same procedure as in Example 12 except that particles of calcium carbonate having a particle size of 110 to 250 μm (manufactured by Maruo Calcium K.K.) were used.

Each of these charging members was mounted in the image forming system of FIG. 3, which was operated for printing toner images on paper sheets. Charging noise was measured. Toner fusion was examined by observing the printed image state at the end of 6,000 prints. Toner fusion ratings are numerical ratings, with larger numerical values indicating better images. The results are shown in Table 3.

TABLE 3

| | Type | Size | Noise | Toner fusion rating |
|---|---|---|---|---|
| Example 12 | Acryl MR50G | 40–60 μm | 52.5 dB | 8.0 |
| Example 13 | Acryl MR60G | 60–80 μm | 52.0 dB | 7.5 |
| Example 14 | Nylon Orgasol ES-4 | 38–42 μm | 52.0 dB | 7.0 |
| Example 15 | Silica | 40–90 μm | 52.2 dB | 6.5 |
| Comparative Example 9 | Acryl MR7G | 3–10 μm | 61.5 dB | 4.0 |
| Comparative Example 10 | none | — | 61.0 dB | 7.5 |
| Comparative Example 11 | calcium carbonate | 110–250 μm | 51.0 dB | 5.0 |

Japanese Patent Application Nos. 5-259025, 5-259385, 5-297052, 6-7944, 6-53534 and 6-218884 are incorporated herein by reference.

Although the hereinabove described embodiments constitute preferred embodiments of the invention, it can be understood that modifications can be made thereto without departing from the scope of the invention as set forth in the appended claims.

We claim:

1. A charging member which is contacted at its surface with an object to be charged wherein the object is charged by applying a voltage between the charging member and the object, the surface of said charging member in contact with the object being formed of a resin layer comprising a nylon copolymer selected from the group consisting of nylon 6/66/12, 6/610/12, 6/612/12, 6/66/610/12, 6/66/11/12, 6/69/610/12, 6/66/69/12, 6/66/612/12, and 6/610/11/12, said nylon copolymer containing at least 15% by weight of nylon 12.

2. The charging member of claim 1 wherein said resin layer has a melting point of up to 120° C.

3. The charging member of claim 1 or 2 wherein said resin layer further contains a conductive powder.

4. A charging apparatus comprising a charging member which is contacted at its surface with an object to be charged and means for applying a voltage between said charging member and said object, the surface of said charging member in contact with the object being formed of a resin layer comprising a nylon copolymer selected from the group consisting of nylon 6/66/12, 6/610/12, 6/612/12, 6/66/610/12 6/66/11/12, 6/69/610/12, 6/66/69/12, 6/66/612/12, and 6/610/11/12, said nylon copolymer containing at least 15% by weight of nylon 12.

5. The charging apparatus of claim 4 wherein said resin layer has a melting point of up to 120° C.

6. The charging apparatus of claim 4 or 5 wherein said resin layer further contains a conductive powder.

7. A charging member which is contacted at its surface with an object to be charged wherein the object is charged by applying a voltage between the charging member and the object, the surface of said charging member in contact with the object being formed of a resin layer comprising a urethane-modified acrylic resin containing 5 to 80% by weight of an acrylic resin component.

8. The charging member of claim 7 wherein said urethane-modified acrylic resin further contains 1 to 50% by weight of a silicone component.

9. The charging member of claim 7 or 8 wherein said resin layer further contains a conductive powder.

10. The charging member of claim 7 or 8 wherein said resin layer further contains silica.

11. The charging member of claim 7 or 8 wherein said resin layer further contains curing agent.

12. A charging apparatus comprising a charging member which is contacted at its surface with an object to be charged and means for applying a voltage between said charging member and said object, the surface of said charging member in contact with the object being formed of a resin layer comprising a urethane-modified acrylic resin containing 5 to 80% by weight of an acrylic resin component.

13. The charging apparatus of claim 12 wherein said urethane-modified acrylic resin further contains 1 to 50% by weight of a silicone component.

14. The charging apparatus of claim 12 or 13 wherein said resin layer further contains a conductive powder.

15. The charging apparatus of claim 12 or 13 wherein said resin layer further contains silicic anhydride, silicic acid hydrate or a silicate.

16. The charging apparatus of claim 12 or 13 wherein said resin layer further contains curing agent.

17. A charging member which is contacted at its surface with an object to be charged wherein the object is charged by applying a voltage between the charging member and the object, particles having a particle size of 35 to 100 μm being distributed in the proximity of the surface of said charging member in contact with said object.

18. The charging member of claim 17 wherein said particles are of an acrylic resin of crosslinking type.

19. A charging apparatus comprising a charging member which is contacted at its surface with an object to be charged and means for applying a voltage between said charging member and said object, particles having a particle size of 35 to 100 μm being distributed in the proximity of the surface of said charging member in contact with said object.

20. The charging apparatus of claim 19 wherein said particles are of an acrylic resin of crosslinking type.

* * * * *